US010424316B2

(12) United States Patent
Lin et al.

(10) Patent No.: US 10,424,316 B2
(45) Date of Patent: Sep. 24, 2019

(54) AUDIO PROCESSING APPARATUS AND AUDIO PROCESSING METHOD

(71) Applicant: Merry Electronics(Shenzhen) Co., Ltd., ShenZhen (CN)

(72) Inventors: Hung-Chi Lin, Taichung (TW); Mao-Hung Lin, Taichung (TW); Syue-Yu Jhang, Taichung (TW); Yi-Lin Hsieh, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 0 days.

(21) Appl. No.: 16/026,078

(22) Filed: Jul. 3, 2018

(65) Prior Publication Data

US 2019/0251983 A1 Aug. 15, 2019

(30) Foreign Application Priority Data

Feb. 14, 2018 (TW) ..... 107105542 A

(51) Int. Cl.

| | |
|---|---|
| ***G10L 21/0208*** | (2013.01) |
| ***H04R 1/22*** | (2006.01) |
| ***H04R 3/00*** | (2006.01) |
| *G10L 21/0216* | (2013.01) |

(52) U.S. Cl.

CPC ..... *G10L 21/0208* (2013.01); *H04R 1/222* (2013.01); *H04R 3/005* (2013.01); *G10L 2021/02087* (2013.01); *G10L 2021/02166* (2013.01)

(58) Field of Classification Search

None

See application file for complete search history.

(56) References Cited

U.S. PATENT DOCUMENTS

2005/0089148 A1* 4/2005 Stokes, III ..... H04M 9/082 379/3

2007/0019802 A1* 1/2007 Ubriaco ..... H04M 9/082 379/406.01

* cited by examiner

*Primary Examiner* — James K Mooney

(74) *Attorney, Agent, or Firm* — JCIPRNET

(57) ABSTRACT

An audio processing apparatus and an audio processing method are provided. The audio processing apparatus includes a microphone array, a processor, and an audio signal processor. The microphone array is configured to provide an external audio signal having a first sampling frequency. The external audio signal includes a first audio signal and a second audio signal. The processor provides a first setting command and a second setting command according to the external audio signal and the second audio signal. The audio signal processor generates the second audio signal having a second sampling frequency according to the first setting command, adjusts the second sampling frequency of the second audio signal to the first sampling frequency according to the second setting command, and separates the first audio signal in the external audio signal according to the second audio signal having the first sampling frequency.

18 Claims, 5 Drawing Sheets

AUDIO PROCESSING APPARATUS AND AUDIO PROCESSING METHOD

CROSS-REFERENCE TO RELATED APPLICATION

This application claims the priority benefit of Taiwan application serial no. 107105542, filed on Feb. 14, 2018. The entirety of the above-mentioned patent application is hereby incorporated by reference herein and made a part of this specification.

BACKGROUND OF THE INVENTION

Field of the Invention

The disclosure relates to an audio processing apparatus and an audio processing method.

Description of Related Art

In current audio processing techniques, how to effectively separate an audio command and a non-audio command signal (e.g., music being played) in an audio signal collected by a microphone array is one of the issues in audio processing that currently require technical research. However, when a sampling frequency of the music being played, for example, is different from a sampling frequency of the microphone array, the audio command cannot be easily separated from the audio signal. In that case, recognizability of the audio command is lowered, which causes a corresponding audio processing apparatus to generate an inaccurate operation service according to the unclear audio command.

SUMMARY OF THE INVENTION

The embodiments of the invention provide an audio processing apparatus and an audio processing method for enhancing recognizability of audio commands and maintaining high-quality music playing effect.

An embodiment of the invention provides an audio processing apparatus. The audio processing apparatus includes a microphone array, a processor, and an audio signal processor. The microphone array receives an external audio signal to provide the external audio signal having a first sampling frequency, wherein the external audio signal includes a first audio signal and a second audio signal. The processor receives the second audio signal, and provides a first setting command and a second setting command according to the external audio signal and the second audio signal. The audio signal processor is coupled between the microphone array and the processor. The audio signal processor receives the external audio signal via the microphone array and receives the second audio signal via the processor. The audio signal processor generates the second audio signal having a second sampling frequency according to the first setting command, and adjusts the second sampling frequency of the second audio signal to the first sampling frequency according to the second setting command. The audio signal processor separates the first audio signal in the external audio signal according to the second audio signal having the first sampling frequency.

An embodiment of the invention provides an audio processing method including the following steps. An external audio signal is received to provide the external audio signal having a first sampling frequency, wherein the external audio signal includes a first audio signal and a second audio signal. The second audio signal is received, and a first setting command and a second setting command are provided according to the external audio signal and the second audio signal. The second audio signal having a second sampling frequency is generated according to the first setting command. The second sampling frequency of the second audio signal is adjusted to the first sampling frequency according to the second setting command. The first audio signal in the external audio signal is separated according to the second audio signal having the first sampling frequency.

Accordingly, the audio processing apparatus of the embodiments of the invention receives the external audio signal having the first sampling frequency and the second audio signal. The audio processing apparatus generates the second audio signal having the second sampling frequency and adjusts the second sampling frequency of the second audio signal to the first sampling frequency. The audio processing apparatus separates the first audio signal in the external audio signal according to the second audio signal having the first sampling frequency to enhance recognizability of audio commands in a music playing environment and maintain high-quality music playing effect.

To provide a further understanding of the aforementioned and other features and advantages of the disclosure, exemplary embodiments, together with the reference drawings, are described in detail below.

DESCRIPTION OF THE EMBODIMENTS

Figure 1:
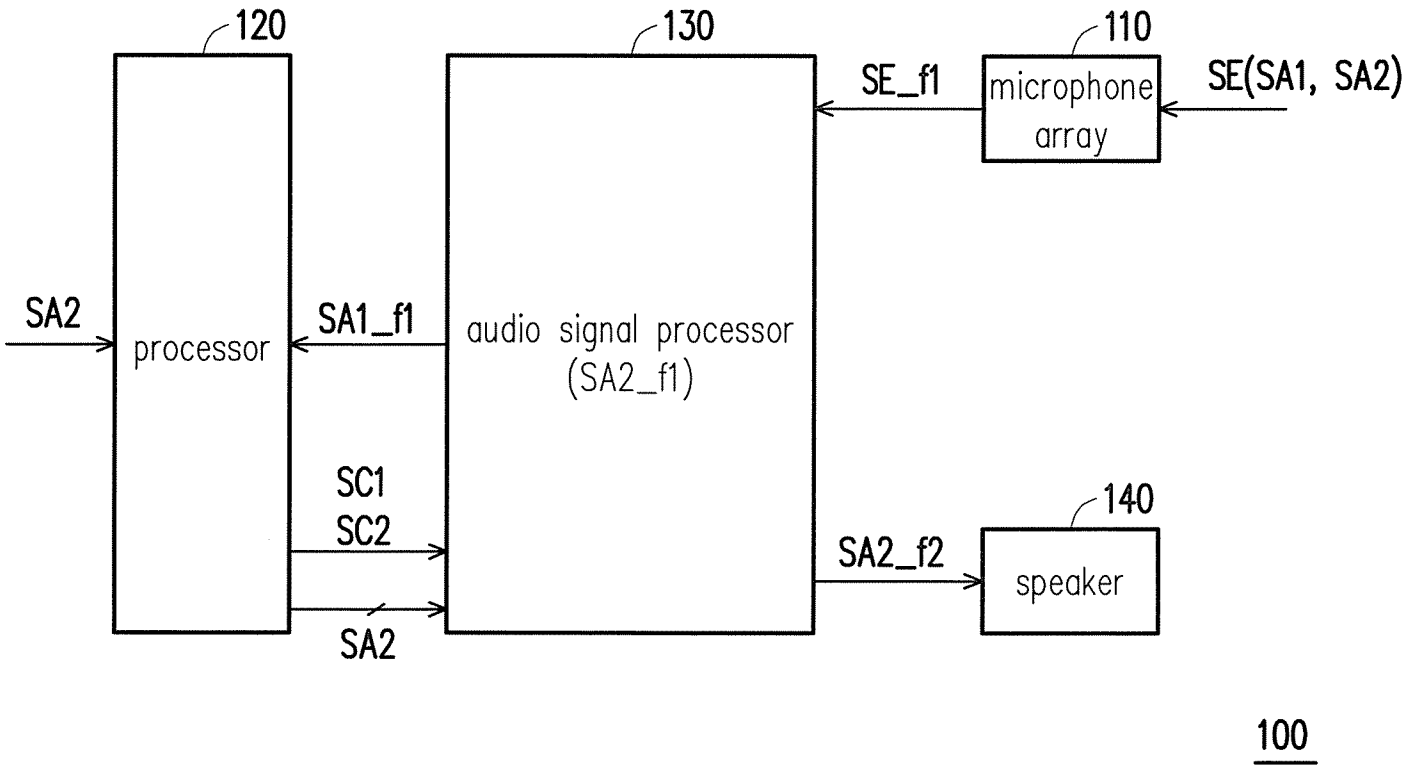
FIG. 1 is a schematic diagram illustrating an audio processing apparatus according to an embodiment of the invention.

Referring to FIG. 1, which is a schematic diagram illustrating an audio processing apparatus according to an embodiment of the invention. An audio processing apparatus 100 includes a microphone array 110, a processor 120, and an audio signal processor 130. The microphone array 110 is configured to receive an external audio signal SE. The external audio signal SE includes a first audio signal SA1 and a second audio signal SA2. In the present embodiment, a sampling frequency of the microphone array 110 is a first sampling frequency f1. Therefore, after receiving the external audio signal SE, the microphone array 110 provides the external audio signal SE_f1 having the first sampling frequency f1 (e.g., 16 kHz or 48 kHz). In the present embodiment, the first audio signal SA1 comes from an audio command provided by a user, and the second audio signal SA2 is, for example, an audio signal (e.g., music) which is not an audio command.

The processor 120 receives the second audio signal SA2, and the processor 120 provides a first setting command SC1 and a second setting command SC2 according to the external audio signal SE_f1 and the second audio signal SA2. In the present embodiment, the processor 120 is, for example, an audio codec. The processor 120 receives the second audio signal SA2 via an Integrated Interchip Sound (I2S) transmission interface, a Universal Serial Bus (USB), a Serial Peripheral Interface (SPI) Bus, a Universal Asynchronous Receiver/Transmitter (UART), or a wireless network interface, for example. In the present embodiment, in a case where the microphone array 110 is disposed on the audio processing apparatus 100, the processor 120 obtains the first sampling frequency f1 of the external audio signal SE_f1.

The audio signal processor 130 is coupled between the microphone array 110 and the processor 120. The audio signal processor 130 may be connected with the processor 120 via the I2S or SPI transmission interface, for example. The audio signal processor 130 generates the second audio signal SA2_f2 having a second sampling frequency f2 (e.g., 8 kHz to 768 kHz) according to the first setting command SC1. The audio signal processor 130 adjusts the second sampling frequency f2 of the second audio signal SA2_f2 to the first sampling frequency f1 according to the second setting command SC2. For example, the second sampling frequency f2 of the second audio signal SA2_f2 is 192 kHz, and the first sampling frequency f1 is 48 kHz. After adjustment by the audio signal processor 130, the second audio signal SA2_f1 is an audio signal having a sampling frequency of 48 kHz. The audio signal processor 130 separates the first audio signal SA1_f1 having the first sampling frequency f1 in the external audio signal SE_f1 according to the second audio signal SA2_f1 having the first sampling frequency f1. In the present embodiment, the audio processing apparatus 100 further includes a speaker 140. The speaker 140 is coupled to the audio signal processor 130. The speaker 140 is configured to output the second audio signal SA2_f2 provided by the audio signal processor 130.

Figure 2:
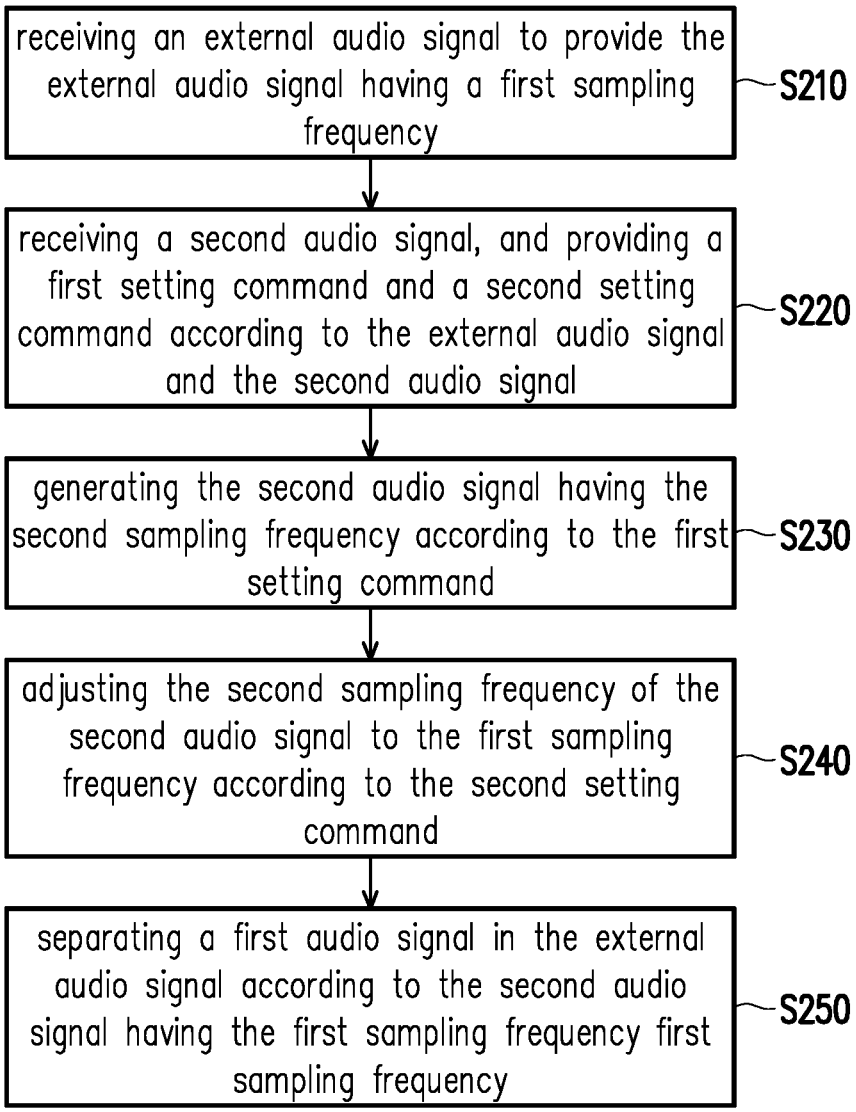
FIG. 2 is a flowchart illustrating an audio processing method according to an embodiment of the invention.

Referring to both FIG. 1 and FIG. 2, FIG. 2 is a flowchart illustrating an audio processing method according to an embodiment of the invention. In step S210, the microphone array 110 receives an external audio signal SE and provides the external audio signal SE_f1 having a first sampling frequency f1. In step S220, the processor 120 receives a second audio signal SA2 and obtains a second sampling frequency f2 of the second audio signal SA2, and the processor 120 provides a first setting command SC1 and a second setting command SC2 according to the external audio signal SE_f1 and the second audio signal SA2. The audio signal processor 130 receives the external audio signal SE_f1 provided by the microphone array 110 and receives the second audio signal SA2_f2 from the processor 120. In step S230, the audio signal processor 130 generates the second audio signal SA2_f2 having the second sampling frequency f2 according to the first setting command SC1. In step S240, the second sampling frequency f2 of the second audio signal SA2_f2 is adjusted to the first sampling frequency f1 according to the second setting command SC2 to generate the second audio signal SA2_f1 having the first sampling frequency f1. In step S250, the audio signal processor 130 separates a first audio signal SA1_f1 in the external audio signal SE_f1 according to the second audio signal SA2_f1 having the first sampling frequency f1.

Figure 3:
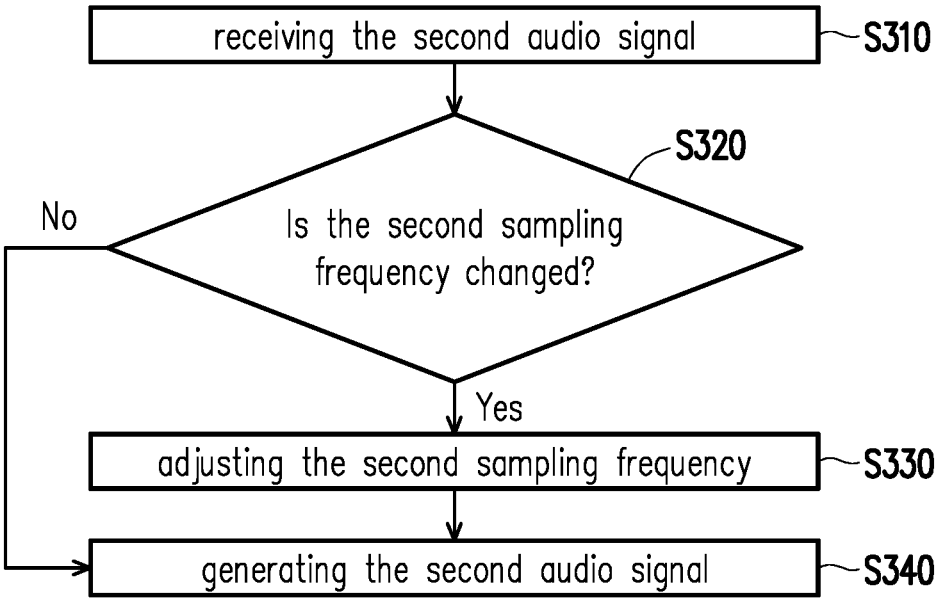
FIG. 3 is a flowchart illustrating a processing method of a second audio signal according to an embodiment of the invention.

A processing method of the second audio signal SA2_f2 is further described. Referring to FIG. 1 and FIG. 3, FIG. 3 is a flowchart illustrating a processing method of the second audio signal according to an embodiment of the invention. Specifically, steps S310 to S320 correspond to step S220 in FIG. 2, and steps S330 to S340 correspond to step S230 in FIG. 2. In the embodiment of FIG. 1 and FIG. 3, the processor 120 receives the second audio signal SA2 in step S310 and determines in step S320 whether the second sampling frequency f2 of the current second audio signal SA2 is changed. When the processor 120 determines that the second sampling frequency f2 is changed (namely, when the second sampling frequency f2 of the current second audio signal SA2 is different from a second sampling frequency f2' (not illustrated) of a previously received second audio signal SA2' (not illustrated)), the processor 120 provides the first setting command SC1 to the audio signal processor 130 to instruct the audio signal processor 130 to adjust a sampling frequency of the audio signal processor 130 from the second sampling frequency f2' to the second sampling frequency f2 and receive the current second audio signal SA2. The audio signal processor 130 receives the current second audio signal SA2 according to the first setting command SC1, and adjusts the second sampling frequency f2' of the audio signal processor 130 to the second sampling frequency f2 in step S330. Next, in step S340, the audio signal processor 130 generates the second audio signal SA2_f2 having the adjusted second sampling frequency f2. Conversely, when the processor 120 determines that the second sampling frequency f2 is not changed (namely, when the second sampling frequency f2 of the current second audio signal SA2_f2 is identical to the second sampling frequency f2' of the previously received second audio signal SA2'), the processor 120 provides the first setting command SC1 to the audio signal processor 130 to instruct the audio signal processor 130 to receive the current second audio signal SA2_f2. The audio signal processor 130 does not adjust the second sampling frequency f2', and generates the second audio signal SA2_f2 in step S340.

For example, after the processor 120 receives a current music signal in step S310, the processor 120 determines in step S320 whether the second sampling frequency f2 of the current music signal is identical to the second sampling frequency f2' of a previous music signal. When the processor 120 determines that the second sampling frequency f2 of the current music signal is different from the second sampling frequency f2' of the previous music signal, the processor 120 provides the first setting command SC1 to the audio signal processor 130. The audio signal processor 130 then adjusts the second sampling frequency f2' to the second sampling frequency f2 according to the first setting command SC1 in step S330, and generates the current music signal having the adjusted second sampling frequency f2 in step S340. In other words, the determination operation by the processor 120 in step S320, the provision of the first setting command SC1, and the adjustment of the second sampling frequency by the audio signal processor 130 in step S330 are all performed after the previous music signal is over and before the current music signal is started.

The audio processing apparatus 100 may further include the speaker 140. The speaker 140 is configured to play the second audio signal SA2_f2 having the second sampling frequency f2 (e.g., 8 kHz to 768 kHz) generated by the audio signal processor 130. Accordingly, after receiving the second audio signal SA2_f2, the audio processing apparatus 100 can maintain high-quality audio signal playing effect.

Figure 4:
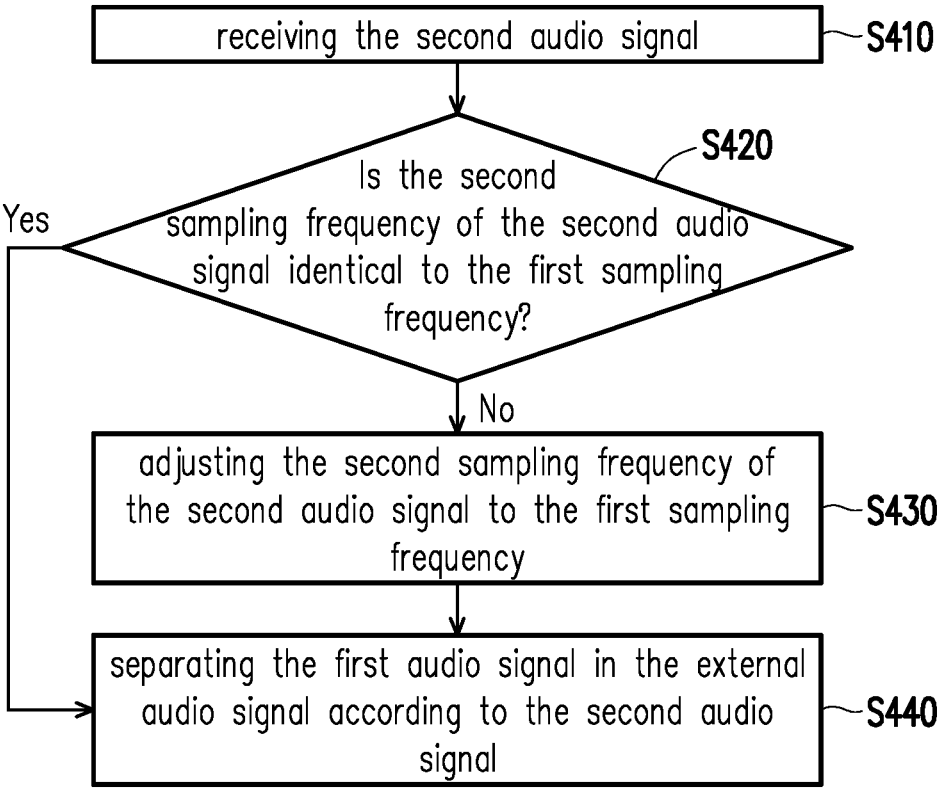
FIG. 4 is a flowchart illustrating a processing method of a first audio signal according to an embodiment of the invention.

Furthermore, referring to both FIG. 1 and FIG. 4, FIG. 4 is a flowchart illustrating a processing method of the first audio signal according to an embodiment of the invention. Specifically, steps S410 to S420 correspond to step S220 in FIG. 2, step S430 corresponds to step S240 in FIG. 2, and step S440 corresponds to step S250 in FIG. 2. After the processor 120 receives the second audio signal SA2_f2 in step S410, the processor 120 determines in step S420 whether the second sampling frequency f2 of the second audio signal SA2_f2 is identical to the first sampling frequency f1 provided by the microphone array. When the processor 120 determines in step S420 that the second sampling frequency f2 of the second audio signal SA2_f2 is different from the first sampling frequency f1, the processor 120 provides the second setting command SC2 to the audio signal processor 130 to instruct the audio signal processor 130 to adjust the second sampling frequency f2 of the second audio signal SA2_f2 to the first sampling frequency f1. In step S430, the audio signal processor 130 adjusts the second sampling frequency f2 of the second audio signal SA2_f2 to the first sampling frequency f1 according to the second setting command SC2 to generate the second audio signal SA2_f1 having the first sampling frequency f1. Next, in step S440, the audio signal processor 130 separates the first audio signal SA1_f1 in the external audio signal SE_f1 according to the second audio signal SA2_f1 having the first sampling frequency f1. Conversely, when the processor 120 determines in step S420 that the second sampling frequency f2 of the second audio signal SA2_f2 is identical to the first sampling frequency f1, the processor 120 provides the second setting command SC2 to the audio signal processor 130 to instruct the audio signal processor 130 not to adjust the second sampling frequency f2. The audio signal processor 130 then does not adjust the second sampling frequency f2 of the second audio signal SA2_f2 according to the second setting command SC2, and separates the first audio signal SA1_f1 in the external audio signal SE_f1 according to the second audio signal SA2_f2 (since the second sampling frequency f2 is identical to the first sampling frequency f1, the second audio signal SA2_f2 may be regarded as the second audio signal SA2_f1) in step S440.

It is noted that the audio signal processor 130 receives the external audio signal SE_f1 and the second audio signal SA2_f1 having the first sampling frequency f1, and separates the first audio signal SA1_f1 in the external audio signal SE_f1 according to the second audio signal SA2_f1. Accordingly, the audio processing apparatus 100 can effectively filter the second audio signal SA2_f1 in the external audio signal SE_f1 and separate the first audio signal SA1_f1 to enhance recognizability of audio commands.

In the present embodiment, the audio signal processor 130 may separate the first audio signal SA1_f1 through signal separation mechanisms including a blind sources separation method, an acoustic echo cancellation method, direction of arrival estimation, and beamforming, for example.

Referring to FIG. 1 again, in the embodiment of FIG. 1, after the audio signal processor 130 separates the first audio signal SA1_f1, the processor 120 receives the first audio signal SA1_f1 and outputs the first audio signal. In the present embodiment, the processor 120 further obtains an audio command in the first audio signal SA1_f1, and the processor 120 may provide an operation service corresponding to the audio command according to the audio command. In some embodiments, the processor 120 may further transmit the first audio signal SA1_f1 to an external electronic device or cloud database (not illustrated). The external electronic device or cloud database may obtain the audio command according to the first audio signal SA1_f1 and provide the operation service corresponding to the audio command according to the audio command.

In some embodiments, the processor 120 may further receive the first setting command SC1 and the second setting command SC2 fed back by the audio signal processor 130 to record a setting history provided by the processor 120 itself.

Figure 5:
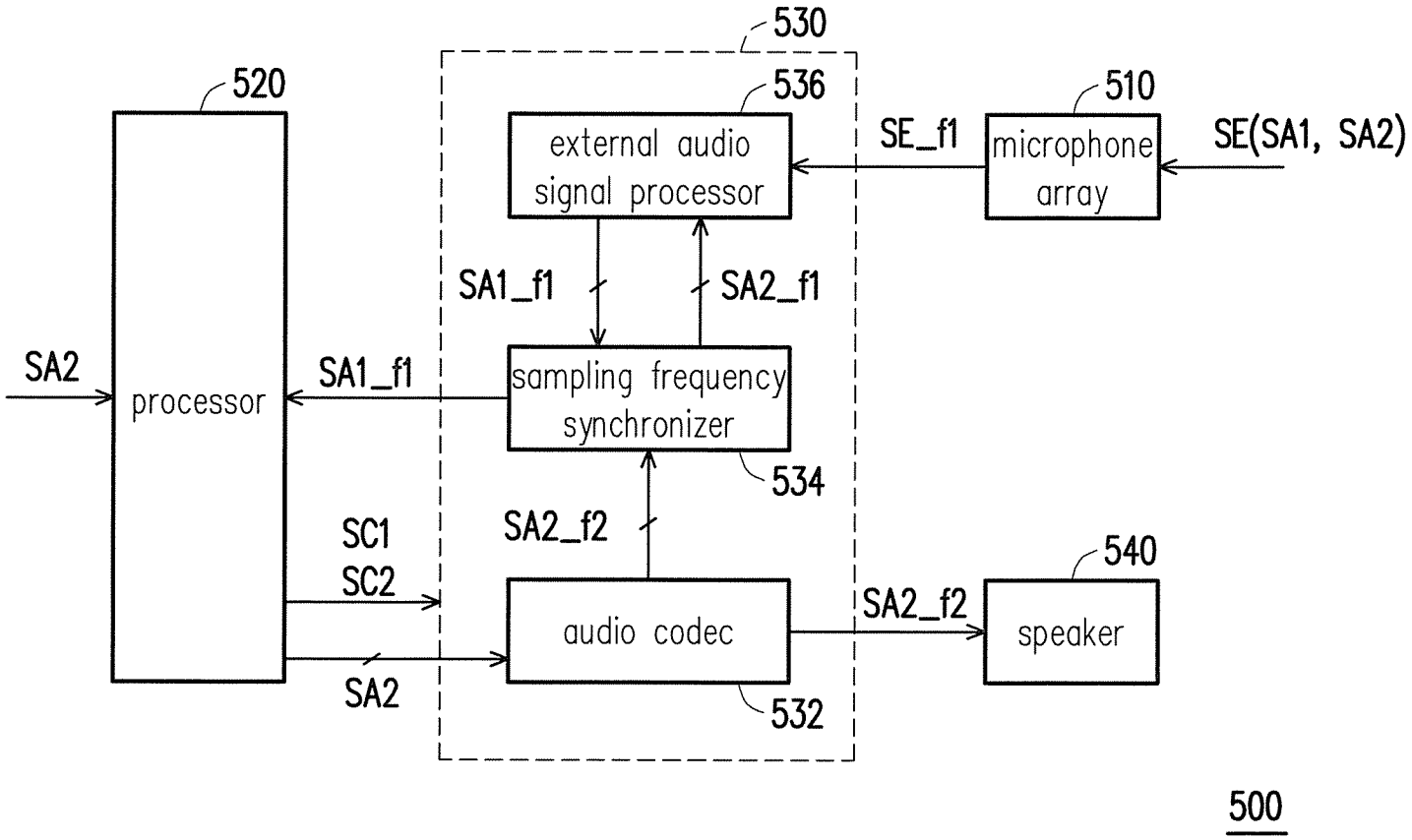
FIG. 5 is a schematic diagram illustrating an audio processing apparatus according to another embodiment of the invention.

Referring to FIG. 5, which is a schematic diagram illustrating an audio processing apparatus according to another embodiment of the invention. In the present embodiment, an audio signal processor 530 of an audio processing apparatus 500 includes an audio codec 532, a sampling frequency synchronizer 534, and an external audio signal processor 536. The audio codec 532 is coupled to a processor 520. The audio codec 532 may receive a first setting command SC1 provided by the processor 520 via an I2S transmission interface, adjust a sampling frequency of the audio codec 532 to the second sampling frequency f2 according to the first setting command SC1, and receive a second audio signal SA2 via the processor 520 to generate the second audio signal SA2_f2 having the second sampling frequency f2. In the present embodiment, the audio processing apparatus 500 further includes a speaker 540. The speaker 540 is coupled to the audio codec 532 and is configured to play the second audio signal SA2_f2 provided by the audio codec 532.

The sampling frequency synchronizer 534 is coupled to the audio codec 532. The sampling frequency synchronizer 534 receives the second audio signal SA2_f2 from the audio codec 532. The sampling frequency synchronizer 534 adjusts the second sampling frequency f2 of the second audio signal SA2_f2 to the first sampling frequency f1 according to a second setting command SC2 provided by the processor 520 to generate the second audio signal SA2_f1 having the first sampling frequency f1. In the present embodiment, the sampling frequency synchronizer 534 may directly receive the second setting command SC2 provided by the processor 520. In some other embodiments, the sampling frequency synchronizer 534 may receive the second setting command SC2 provided by the processor 520 via the audio codec 532 to reduce connection pins between the audio signal processor 530 and the processor 520. The embodiments of the invention do not limit the transmission path of the second setting command SC2.

The external audio signal processor 536 is coupled to the sampling frequency synchronizer 534. The external audio signal processor 536 receives the second audio signal SA2_f1 provided by the sampling frequency synchronizer 534 and the external audio signal SE_f1 provided by the microphone array 510. The external audio signal processor 536 separates a first audio signal SA1_f1 according to the second audio signal SA2_f1 through signal separation mechanisms including a blind sources separation method, an acoustic echo cancellation method, direction of arrival estimation, and beamforming, for example.

In some embodiments, the external audio signal processor 536 may have a sampling frequency for further converting a sampling frequency of an external audio signal SE_f1 provided by a microphone array 510. Accordingly, in the process of separating the first audio signal SA, the audio signal processor 530 of the audio processing apparatus 500 is not limited to the sampling frequency of the microphone array 510 but may be based on the sampling frequency in the external audio signal processor 536. The sampling frequency of the external audio signal processor 536 is set based on a third setting command provided by the processor 520 or is set based on a default boot parameter.

In the present embodiment, after separating the first audio signal SA1_f1, the external audio signal processor 536 transmits the first audio signal SA1_f1 to the sampling frequency synchronizer 534. The sampling frequency synchronizer 534 may transmit the first audio signal SA1_f1 to the processor 520. In the present embodiment, the sampling frequency synchronizer 534 may also further adjust the first sampling frequency f1 of the first audio signal SA1_f1 to generate the first audio signal SA1_f3 (not illustrated) having a third sampling frequency f3. The sampling frequency synchronizer 534 transmits the first audio signal SA1_f3 to the processor 520.

In summary of the above, the audio processing apparatus of the embodiments of the invention receives the external audio signal having the first sampling frequency and the second audio signal. The audio processing apparatus generates the second audio signal having the second sampling frequency and adjusts the second sampling frequency of the second audio signal to the first sampling frequency to maintain high-quality playing effect of the second audio signal. Moreover, the audio processing apparatus separates the first audio signal in the external audio signal according to the second audio signal having the first sampling frequency. Accordingly, audio commands can be clearly recognized in an environment where the second audio signal is played, which enables the audio processing apparatus to provide an accurate operation service.

Although the invention is disclosed as the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. An audio processing apparatus comprising:

a microphone array, receiving an external audio signal to provide the external audio signal having a first sampling frequency, wherein the external audio signal comprises a first audio signal and a second audio signal;

a processor, receiving the second audio signal, and providing a first setting command and a second setting command according to the external audio signal and the second audio signal; and an audio signal processing circuit, coupled between the microphone array and the processor, receiving the second audio signal from the processor to generate a sampled second audio signal having a second sampling frequency according to the first setting command, receiving the external audio signal having the first sampling frequency from the microphone array, adjusting the second sampling frequency of the sampled second audio signal to the first sampling frequency according to the second setting command, and separating the first audio signal in the external audio signal according to the sampled second audio signal having the first sampling frequency, wherein when the sampling frequency of the second audio signal received by the processor is changed, the processor provides the first setting command to the audio signal processing circuit to adjust the second sampling frequency and generate the sampled second audio signal having the adjusted second sampling frequency.

2. The audio processing apparatus according to claim 1, wherein when the second sampling frequency of the sampled second audio signal is different from the first sampling frequency, the processor provides the second setting command to the audio signal processing circuit to have the audio signal processing circuit adjust the second sampling frequency of the sampled second audio signal to the first sampling frequency.

3. The audio processing apparatus according to claim 1, wherein the processor receives the first audio signal and outputs the first audio signal.

4. The audio processing apparatus according to claim 1, wherein the audio signal processing circuit comprises:

an audio codec, coupled to the processor, receiving the first setting command provided by the processor and adjusting the second sampling frequency according to the first setting command, and receiving the second audio signal via the processor to generate the sampled second audio signal having the second sampling frequency.

5. The audio processing apparatus according to claim 4, further comprising:

a speaker, coupled to the audio codec, playing the sampled second audio signal having the second sampling frequency.

6. The audio processing apparatus according to claim 4, wherein the audio signal processing circuit comprises:

a sampling frequency synchronizer, coupled to the audio codec, receiving the sampled second audio signal having the second sampling frequency from the audio codec, and adjusting the second sampling frequency of the sampled second audio signal to the first sampling frequency according to the second setting command to generate the sampled second audio signal having the first sampling frequency.

7. The audio processing apparatus according to claim 6, wherein the audio signal processing circuit further comprises:

an external audio signal processing circuit, coupled to the sampling frequency synchronizer, receiving the sampled second audio signal having the first sampling frequency and receiving the external audio signal, and separating the first audio signal in the external audio signal according to the sampled second audio signal having the first sampling frequency through a signal separation mechanism, wherein a sampling frequency of the external audio signal processing circuit is set based on a third setting command provided by the processor or is set based on a default boot parameter and the first audio signal separated from the external audio signal is sampled by the external audio signal processing circuit.

8. The audio processing apparatus according to claim 7, wherein the signal separation mechanism is a blind sources separation method, an acoustic echo cancellation method, direction of arrival estimation, or beamforming.

9. The audio processing apparatus according to claim 7, wherein the external audio signal processing circuit transmits the first audio signal to the processor via the sampling frequency synchronizer.

10. The audio processing apparatus according to claim 1, wherein the processor further obtains an audio command according to the first audio signal and provides an operation service corresponding to the audio command according to the audio command.

11. An audio processing method comprising:

receiving an external audio signal to provide the external audio signal having a first sampling frequency, wherein the external audio signal comprises a first audio signal and a second audio signal;

receiving the second audio signal, and providing a first setting command and a second setting command according to the external audio signal and the second audio signal;

generating a sampled second audio signal having a second sampling frequency according to the first setting command, wherein the step of generating the sampled second audio signal having the second sampling frequency according to the first setting command comprises:

providing the first setting command to adjust the second sampling frequency to generate the sampled second audio signal having the adjusted second sampling frequency, when the sampling frequency of the second audio signal is changed;

adjusting the second sampling frequency of the sampled second audio signal to the first sampling frequency according to the second setting command; and separating the first audio signal in the external audio signal according to the sampled second audio signal having the first sampling frequency.

12. The audio processing method according to claim 11, wherein the step of generating the sampled second audio signal having the second sampling frequency according to the first setting command further comprises:

playing the sampled second audio signal having the second sampling frequency.

13. The audio processing method according to claim 11, wherein the step of adjusting the second sampling frequency of the sampled second audio signal to the first sampling frequency according to the second setting command comprises:

providing the second setting command to adjust the second sampling frequency of the sampled second audio signal to the first sampling frequency, when the second sampling frequency of the sampled second audio signal is different from the first sampling frequency.

14. The audio processing method according to claim 11, wherein the step of separating the first audio signal in the external audio signal according to the sampled second audio signal having the first sampling frequency comprises:

outputting the first audio signal.

15. The audio processing method according to claim 11, wherein the step of adjusting the second sampling frequency of the sampled second audio signal to the first sampling frequency according to the second setting command comprises:

adjusting the second sampling frequency of the sampled second audio signal to the first sampling frequency according to the second setting command to generate the sampled second audio signal having the first sampling frequency.

16. The audio processing method according to claim 11, wherein the step of separating the first audio signal in the external audio signal according to the sampled second audio signal having the first sampling frequency comprises:

receiving the sampled second audio signal having the first sampling frequency and receiving the external audio signal, and separating the first audio signal in the external audio signal according to the sampled second audio signal having the first sampling frequency through a signal separation mechanism.

17. The audio processing method according to claim 16, wherein the signal separation mechanism is a blind sources separation method, an acoustic echo cancellation method, direction of arrival estimation, or beamforming.

18. The audio processing method according to claim 11, further comprising:

obtaining an audio command according to the first audio signal and providing an operation service corresponding to the audio command according to the audio command.

* * * * *